US010118090B1

(12) United States Patent
Gonzalez

(10) Patent No.: US 10,118,090 B1
(45) Date of Patent: Nov. 6, 2018

(54) SPEED DOMINOES SYSTEMS

(71) Applicant: Richard Gonzalez, Jersey City, NJ (US)

(72) Inventor: Richard Gonzalez, Jersey City, NJ (US)

( * ) Notice: Subject to any disclaimer, the term of this patent is extended or adjusted under 35 U.S.C. 154(b) by 0 days.

(21) Appl. No.: 14/810,420

(22) Filed: Jul. 27, 2015

Related U.S. Application Data

(60) Provisional application No. 62/030,771, filed on Jul. 30, 2014.

(51) Int. Cl.
*A63F 9/20* (2006.01)
*A63F 3/00* (2006.01)
*A63F 9/24* (2006.01)

(52) U.S. Cl.
CPC ..... *A63F 9/20* (2013.01); *A63F 3/00643* (2013.01); *A63F 2003/00233* (2013.01); *A63F 2003/00255* (2013.01); *A63F 2009/2404* (2013.01); *A63F 2009/2405* (2013.01)

(58) Field of Classification Search
CPC ..... A63F 9/20; A63F 2001/0058; A63F 2011/0051; A63F 3/00643; A63F 2009/2404; A63F 2009/2405; A63F 2003/0023; A63F 2003/00233
USPC ..... 273/293, 309, 237, 285
See application file for complete search history.

(56) References Cited

U.S. PATENT DOCUMENTS 4,530,499 A * 7/1985 Breslow ..... A63F 9/28 463/11
4,705,275 A * 11/1987 Slater ..... A63F 9/20 206/315.1
5,938,528 A * 8/1999 Glapion ..... A63F 3/00643 273/293
6,398,642 B1 * 6/2002 Kim ..... A63F 3/00643 273/237
8,596,642 B2 12/2013 Watkins
2008/0318653 A1 12/2008 Lima

* cited by examiner

*Primary Examiner* — Benjamin Layno
(74) *Attorney, Agent, or Firm* — RG Patent Consulting, LLC; Rachel Gilboy

(57) ABSTRACT

An apparatus for electronically enhanced reimagining of the game of dominoes that moves faster than the traditional form and only requires two players instead of the requisite four. Design intent is to provide a more exciting form of a classic game for the 21st century.

17 Claims, 5 Drawing Sheets

SPEED DOMINOES SYSTEMS

CROSS-REFERENCE TO RELATED APPLICATION

The present application is related to and claims priority from prior provisional application serial number 62/030,771, filed Jul. 30, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of games and more specifically relates to a game of speed dominoes.

2. Description of the Related Art

Dominoes are small, rectangular tiles, traditionally carved from ivory or bone and inset with varying numbers of small, round ebony dots. With this distinct black on white look, the name for these tiles is believed to be derived from the French word "domino," which is a style of mask featuring a black and white motif. While the oldest domino sets date from around the year 1120, dominoes as most of the Western world knows them are most likely a Chinese invention. They were apparently derived from cubic dice, which had been introduced into China from India at some point in the distant past. Over time, Chinese dominoes also evolved into the tile set used to play Mah Jongg, a game which swept across the U.S. in the 1920s. Now revered the world over as a classic form of play, dominoes continue to enthrall adults and children alike. People who enjoy playing games always look for improvements in games and entertaining means.

Various attempts have been made to solve problems found in games art. Among these are found in: U.S. Pat. No. 5,938,528 to Andre Glapion; U.S. Pub. No. 2008/0318653 to John W Asermely et al; and U.S. Pat. No. 8,596,642 to Michael Robinson Watkins et al.. This prior art is representative of games.

None of the above inventions and patents, taken either singly or in combination, is seen to describe the invention as claimed. Thus, a need exists for a reliable speed dominoes game to avoid the above-mentioned problems.

BRIEF SUMMARY OF THE INVENTION

In view of the foregoing disadvantages inherent in the known games art, the present invention provides a novel electronically enhanced reimagining of the game of dominoes that moves faster than the traditional form and only requires two players instead of the requisite four. The general purpose of the present invention, which will be described subsequently in greater detail is to provide a more exciting form of a classic game for the 21st century. The features of the invention which are believed to be novel are particularly pointed out and distinctly claimed in the concluding portion of the specification. These and other features, aspects, and advantages of the present invention will become better understood with reference to the following drawings and detailed description.

A speed dominoes gaming system comprises a speed dominoes gaming assembly. The speed dominoes gaming assembly comprises a speed dominoes gaming case, at least two game display screens, at least two electronic key pads, at least two game platforms, at least two digital countdown clocks, at least two score counters, at least two speakers, a plurality of directional buttons, at least two microprocessors, at least two memory units, and at least one rechargeable power supply. The plurality of directional buttons comprise at least a spacer-button, and a pass-button, spacer-button must be pressed within five seconds to facilitate a move and pass-button, when pushed, allows at least two player to skip a move (only if player does not have a move) and points may be lost as time accrues. The more time that passes before the button is pressed, the more points will be lost.

The game platform is integral to the speed dominoes gaming case and is structured and arranged to storably carry the speed dominoes gaming assembly between locations for remote play. The display screen visually displays gameplay for a player, and the electronic key pad and plurality of directional buttons are able to be manipulated for input as to manipulate gameplay. The digital countdown clock is useful for timing gameplay, the timing limited to five seconds during a first level such that when five seconds elapses a turn is lost and a move if not completed within five seconds results in a loss in score for any seconds over five seconds. A second level comprises a timing for gameplay limited to four seconds such that when four seconds elapses a turn is lost if a move isn't made and when four seconds elapses, a penalty of two points incurs for every second over four seconds. A third level comprises a timing for gameplay limited to three seconds such that when three seconds elapses a turn is lost if a move isn't made and when three seconds elapses, a penalty of three points incurs for every second over three seconds. A fourth level comprises a timing for gameplay limited to two seconds such that when two seconds elapses a turn is lost if a move isn't made and when two seconds elapses, a penalty of four points incurs for every second over two seconds.

The score counter provides a record of scoring throughout gameplay. The speaker provides an audibilizing means for announcing gameplay. The microprocessor, memory unit and rechargeable power supply are in communication with each other and provide powering and controlling for speed dominoes gaming assembly for use during gameplay. The speed dominoes gaming system provides entertainment and gameplay is suitable for use by exactly two players. During 'in-use' condition, a first player is able to challenge a second player to play electronic dominos. gameplay lasts no more than 14 moves or seventy seconds, depending on which occurs first.

The speed dominoes gaming system further comprises a kit including at least two speed dominoes gaming assembly, and at least two set of user instructions.

A method of using the speed dominoes gaming system comprises the steps of: opening speed dominoes gaming case, activating a game; timing said move of player using digital countdown clock; taking turns with another player;

playing the game pursuant to game parameters; penalizing player if player takes more than 5 seconds to make a move; winning game by playing all dominoes in hand has placed all domino pieces on the game board or having the least amount of points after a game closure; and selecting between a level one, a level two, a level three, and a level four. The present invention holds significant improvements and serves as a speed dominoes game system.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, speed dominoes gaming systems, constructed and operative according to the teachings of the present invention.

The various embodiments of the present invention will hereinafter be described in conjunction with the appended drawings, wherein like designations denote like elements.

DETAILED DESCRIPTION

Figure 1:
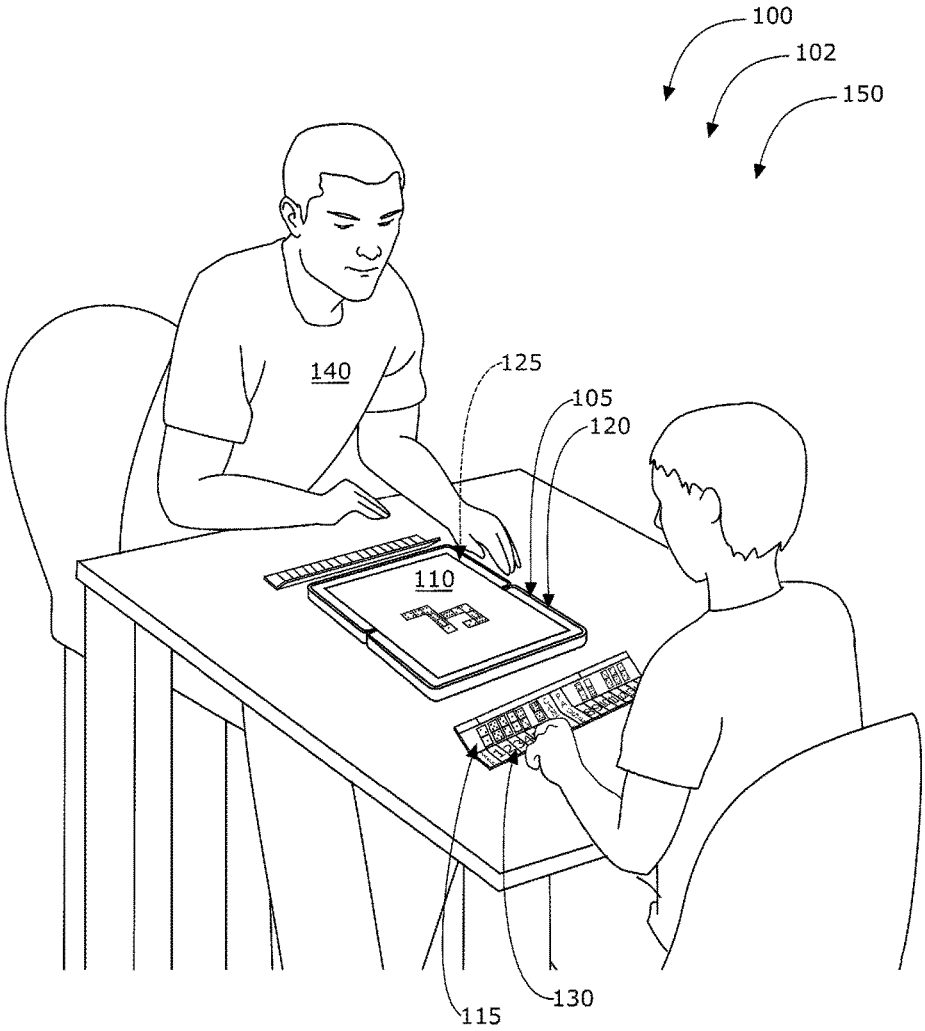
FIG. 1 shows a perspective illustration of a speed dominoes gaming system during an 'in-use' condition showing a first player and a second player playing a game of speed dominoes electronically according to an embodiment of the present invention.

As discussed above, embodiments of the present invention relate to a game of dominoes and more particularly to a speed dominoes gaming system as used to provide a two-player speed dominoes game and to improve the efficiency and entertainment of game players.

Generally speaking, the speed dominoes gaming system comprises an electronically enhanced reimagining of the game of dominoes that moves quicker than the traditional form and only requires two players instead of four. The game may take the form of a computerized gaming platform, complete with directional buttons, a liquid crystal display (LCD) screen, and internal chips and circuitry to facilitate electronic game play. A slimline unit, the Speed Dominoes platform may feature dimensions of approximately seventeen inches (17") in width and one inch (1") in height. In this manner, the unit may resemble the easily viewed and managed electronic readers such as the iPad, Nook, and Kindle.

To facilitate fast play as well as accurate score keeping, the system may offer both a digital countdown clock and a score counter. In describing the playing procedure the inventor recommends that players begin with what he refers to as a level one, "Reg 5 second game," meaning that a player must complete a planned move in five seconds only or lose points. In this form of play, a game of Speed Dominoes may begin with each of the two players, both equipped with synched electronic platforms, tossing a coin to determine who goes first. The winner of the coin toss may then press the "Select Game(s)" button (based on 4 different levels with more points deducted according to higher levels) on the keypad. Once a game is selected and accepted by the two players, all dominos will appear face down on the electronic game board. The winner of the coin toss would act first and select 7 dominoes by dragging one of the face down dominoes from the central domino pool. After 7 pieces are selected, the other player will do the same. This process will be repeated once again such that the winning player of the coin toss selects another 7 dominoes followed by the other player. Upon selection of 14 dominoes total by both players, the game shall automatically commence. Whichever player selects the domino featuring the double sixes, that player must play that particular domino to begin the game. Each player will then have 90 seconds to arrange their dominoes, by selecting two at a time from the same set and pressing down to switch locations. Dominoes may be switched only within their set, set 1 being dominoes number one through seven and set 2 being dominoes number eight through fourteen.

The countdown begins as the player having a domino comprising double sixes (player one) begins to arrange his dominoes; in the recommended first game, as mentioned, this player has only five seconds to make a move. The move is accomplished via a "spacer" button found on the Speed Dominoes keypad. Additionally, a "pass" button may allow a player to lose a turn rather than points if he or she feels that a move cannot be made. Should this player not complete the move within five seconds, his or her score is deducted for each second over five. Play continues between opponents in a similar fashion until a winner is declared for game one, which should last no more than 70 seconds (14 moves) according to the inventor. Speed Dominoes may continue through three (3) more games, with time decreasing with each new game. During game 2, players may have four seconds per move/56 seconds game total with a 2-point per second deduction in score; game 3 may constitute three seconds per move/42 seconds total with a 3-point penalty; and the ultra-challenging game 4 may feature two seconds per move/28 seconds total with a 4-point penalty. Winners of each of the four rounds are awarded bonus points, gaining 100, 75, 50, and 25 respectively.

As the above suggests, the game of Speed Dominoes becomes just that, much faster, and therefore more complicated and thrilling, with each successive round. It should be noted that the inventor intends Speed Dominoes to have the capability of creating over three hundred (300) possible domino combinations, and may generate many different domino-type games for users' optimal enjoyment.

There are many significant benefits and advantages associated with Speed Dominoes. Foremost, this exciting enhancement to the classic tile game may offer consumers hours of delightful, competitive, and challenging fun. Presented as an electronic game board for at least two players, Speed Dominoes may eliminate the standard requirement of four players being necessary for a game. The fast-paced function of Speed Dominoes may provide a fascinating and appealing component to dominoes for current generations, and the multiple levels and hundreds of possible combinations may certainly intrigue those who have never played. As a result, more people may become interested in exploring the level of strategy inherent in the game of dominoes, and can explore a positive outlet that is as intellectually stimulating as it is adrenaline-inducing.

This unique game may be packaged as a compact electronic unit, providing easy storage as well as transport. As such, Speed Dominoes platforms may be easily carried in a backpack, in luggage, or in the car, offering instant entertainment for those meeting friends at a neighborhood lounge, traveling together on business, or embarking on family road trip. Adaptable to emerging technology, this novel creation may be enjoyed for many generations to come.

Speed Dominoes may offer players a fun and exciting electronic game that is perfect for parties, family game nights, or simply to pass the time on a rainy day. With its appealing enhancements to the classic game, this entertaining new form of play may effectively foster both easy camaraderie and fierce competition between opponents.

Referring now to the drawings by numeral of reference, there is shown in FIG. 1 a perspective illustration of speed dominoes gaming system 100 during 'in-use' condition 150 showing player 140 (a first player) competing against another player 140 (a second player) in a game of dominoes electronically according to an embodiment of the present invention. In one embodiment, speed dominoes gaming system 100 may comprise speed dominoes gaming assembly 102. Speed dominoes gaming assembly 102 may comprise speed dominoes gaming case 105, game display screen 110, electronic key pad 115, game platform 120, digital countdown clock 210, score counter 215, speaker 125, plurality of directional buttons 130, microprocessor 305, memory unit 310 and rechargeable power supply 315. Speed dominoes gaming system 100 may provide entertainment to player 140 (a first player) who may be able to play player 140 (a second player) in a game of electronic dominos.

In continuing to refer to FIG. 1, speed dominoes gaming assembly 102 may comprise a first level of speed dominoes gaming system 100. The first level may comprise timing for gameplay limited to five seconds such that when five seconds elapses a turn may be lost. Directional buttons 130 may comprise at least spacer-button 220 and pass-button 222. Spacer-button 220 may be required to be pressed within five seconds to facilitate a move. Pass-button 222, when pushed, may allow player 140 to skip the move so as not to lose the turn. The move if not completed within five seconds may result in a loss in score for any seconds over five seconds. Gameplay may last no more than 14 moves. Gameplay may alternatively last no longer than seventy seconds.

Figure 2A:
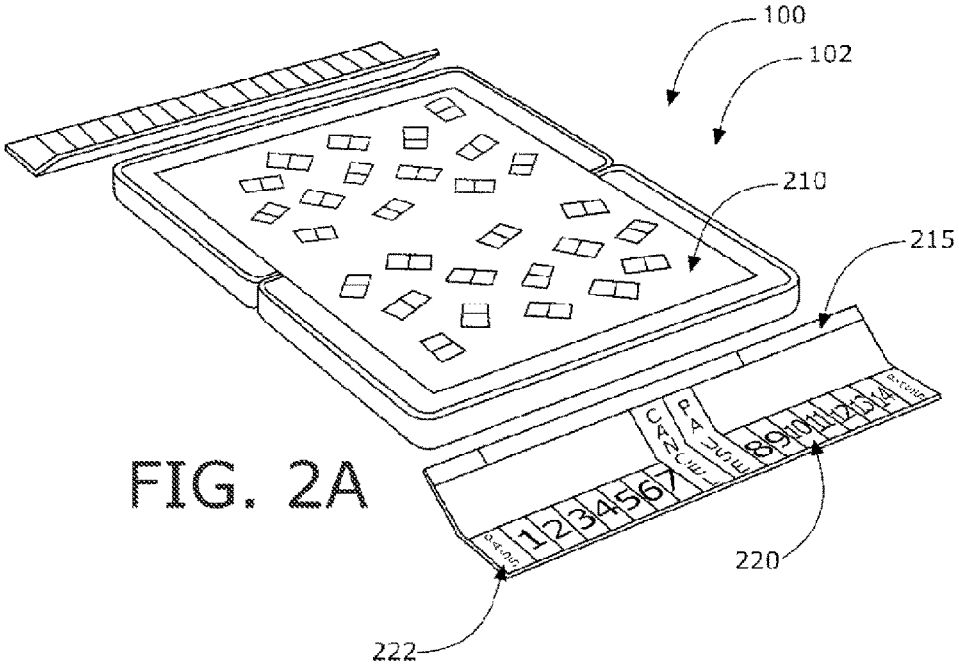
FIG. 2A is a perspective view illustrating a speed dominoes gaming assembly of the speed dominoes gaming system according to an embodiment of the present invention of FIG. 1.

FIG. 2A is a perspective view illustrating speed dominoes gaming assembly 102 of speed dominoes gaming system 100 according to an embodiment of the present invention of FIG. 1. Speed dominoes gaming assembly 102 may comprise speed dominoes gaming system 100. Speed dominoes gaming system 100 may comprise in combination speed dominoes gaming assembly 102 comprising in functional combination speed dominoes gaming case 105, game display screen 110, electronic key pad 115, game platform 120, digital countdown clock 210, score counter 215, speaker 125, directional buttons 130, microprocessor 305, memory unit 310 and rechargeable power supply 315. Game display screen 110 may visually display gameplay for player 140. Electronic key pad 115 and plurality of directional buttons 130 may be able to be manipulated for input as to manipulate gameplay. Digital countdown clock 210 may be useful for timing gameplay, and score counter 215 may provide a record of scoring throughout gameplay. Speaker 125 may provide an audibilizing means for announcing gameplay.

Figure 2B:
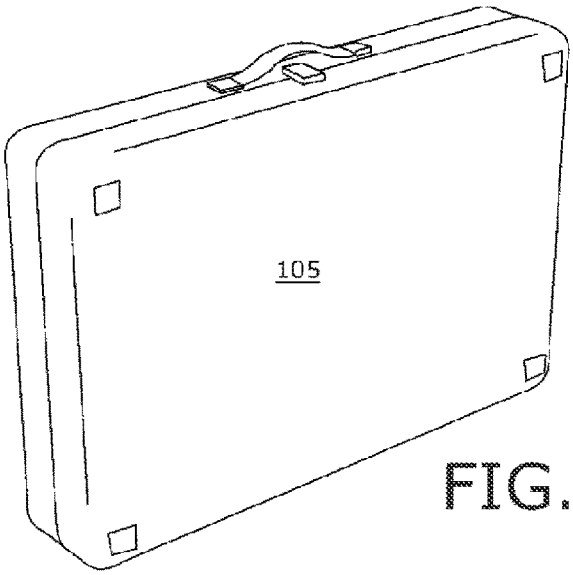
FIG. 2B is a perspective view illustrating a speed dominoes gaming case of the speed dominoes gaming system according to an embodiment of the present invention of FIGS. 1 and 2A.

FIG. 2B is a perspective view illustrating speed dominoes gaming case 105 of the speed dominoes gaming system 100 according to an embodiment of the present invention of FIG. 1. Game platform 120 may be integral to speed dominoes gaming case 105 and may be structured and arranged to storably carry speed dominoes gaming assembly 102 between locations for remote play. Speed dominoes gaming case 105 may include a handle which player 140 may grasp when transporting speed dominoes gaming assembly 102.

Figure 3:
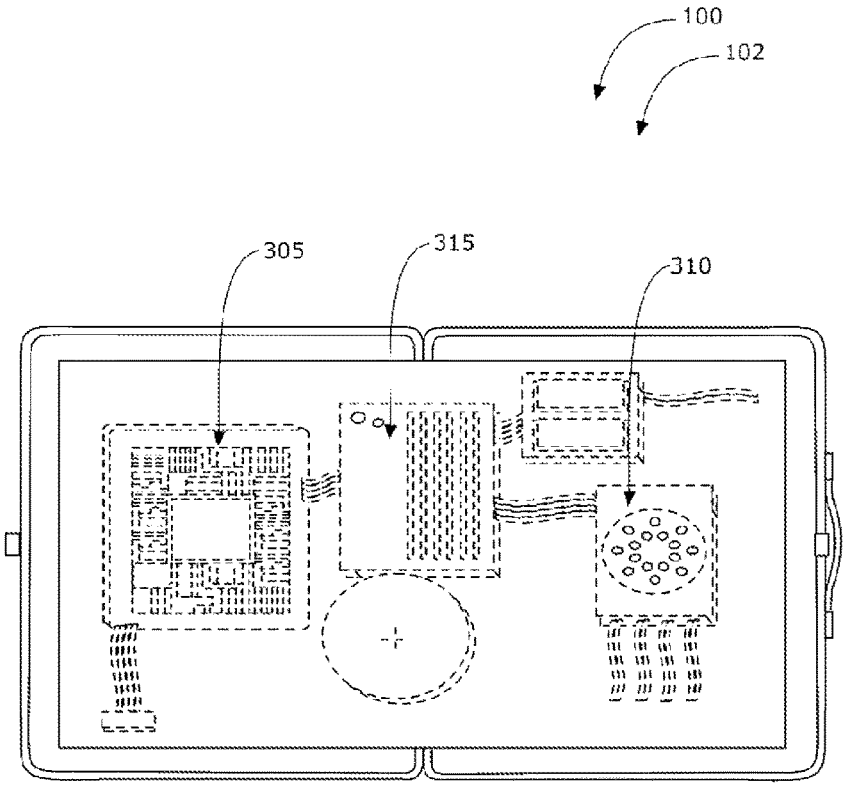
FIG. 3 is a perspective view illustrating a microprocessor and electronic circuitry of the speed dominoes gaming system according to an embodiment of the present invention of FIGS. 1-2B.

FIG. 3 is a perspective view illustrating microprocessor 305 and electronic circuitry of speed dominoes gaming system 100 according to an embodiment of the present invention of FIG. 1. Microprocessor 305, memory unit 310 and rechargeable power supply 315 may be in communication with each other and provide powering and controlling for speed dominoes gaming assembly 102 for use during gameplay. Rechargeable power supply 315 and microprocessor 305 may work in functional combination to provide running power to game display screen 110, electronic key pad 115, speaker 125, directional buttons 130, and digital countdown clock 210. Memory unit 310 may keep a record of scores by player 140 (a first player) and player 140 (a second player).

Figure 4:
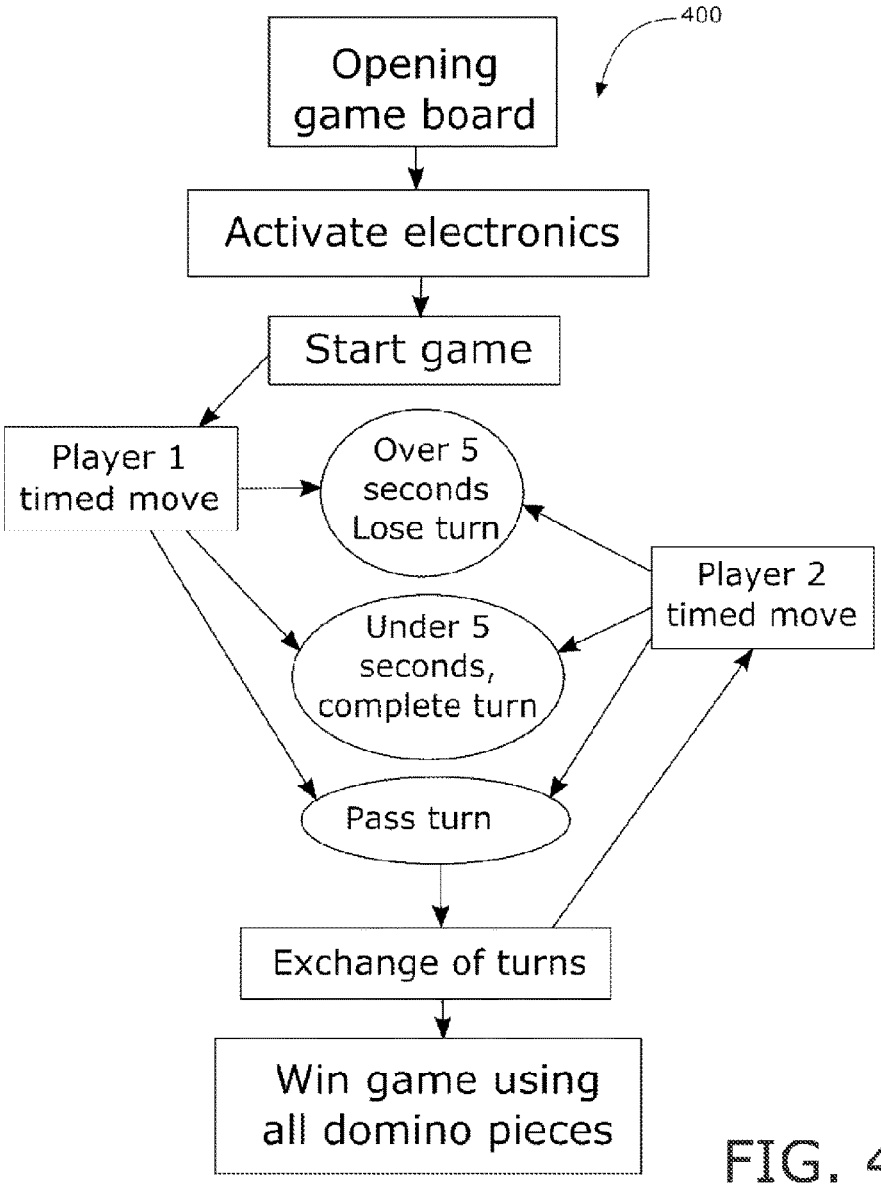
FIG. 4 is a perspective view illustrating a game play flow chart of the speed dominoes gaming system according to an embodiment of the present invention of FIGS. 1-3.

FIG. 4 is a perspective view illustrating game play flow chart 400 of speed dominoes gaming system 100 according to an embodiment of the present invention of FIG. 1. Upon activating the electronic game board and deciding which player 140 will have a first turn, player 140 (a first player) may make a turn via use of spacer-button 220 or may alternatively pass the turn via use of pass-button 222. The move if not completed within five seconds may result in a loss of the turn and forfeiture of score. After player 140 (a first player) has finished the move, player 140 (a second player) may make a turn via use of spacer-button 220 or may alternatively pass the turn via use of pass-button 222. Gameplay may continue until one player 140 has placed all domino pieces on the game board, or when player 140 (a first or second player) may close the game. A game closure may occur when both end tiles comprise the same number and active player 140 (a first or second player) cannot play that number. Once the gameplay is ended via a game closure, player 140 (a first or second player) with the least points wins the game.

In continuing to refer to FIG. 4, speed dominoes gaming system 100 gameplay may comprise levels of varying difficulty. A first level of speed dominoes gaming system 100 may comprise timing for gameplay limited to five seconds such that when five seconds elapses a turn may be lost. A second level may comprise a timing for gameplay limited to four seconds such that when four seconds elapses the turn may be lost if the move isn't made. After four seconds elapses, a penalty of two points may incur for every second over four seconds. A third level may comprise timing for gameplay limited to three seconds such that when three seconds elapses the turn may be lost if the move isn't made. After three seconds elapses, a penalty of three points may incur for every second over three seconds. A fourth level may comprise timing for gameplay limited to two seconds such that when two seconds elapses the turn may be lost if the move isn't made. After two seconds elapses, a penalty of four points may incur for every second over two seconds. Gameplay may be suitable for use by player 140 limit of exactly two.

Speed dominoes gaming system 100 may be sold as a kit comprising the following parts: at least two speed dominoes gaming assembly 102; and at least two set of user instructions. The kit has instructions such that functional relationships are detailed in relation to the structure of the invention (such that the invention can be used, maintained, or the like in a preferred manner). Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
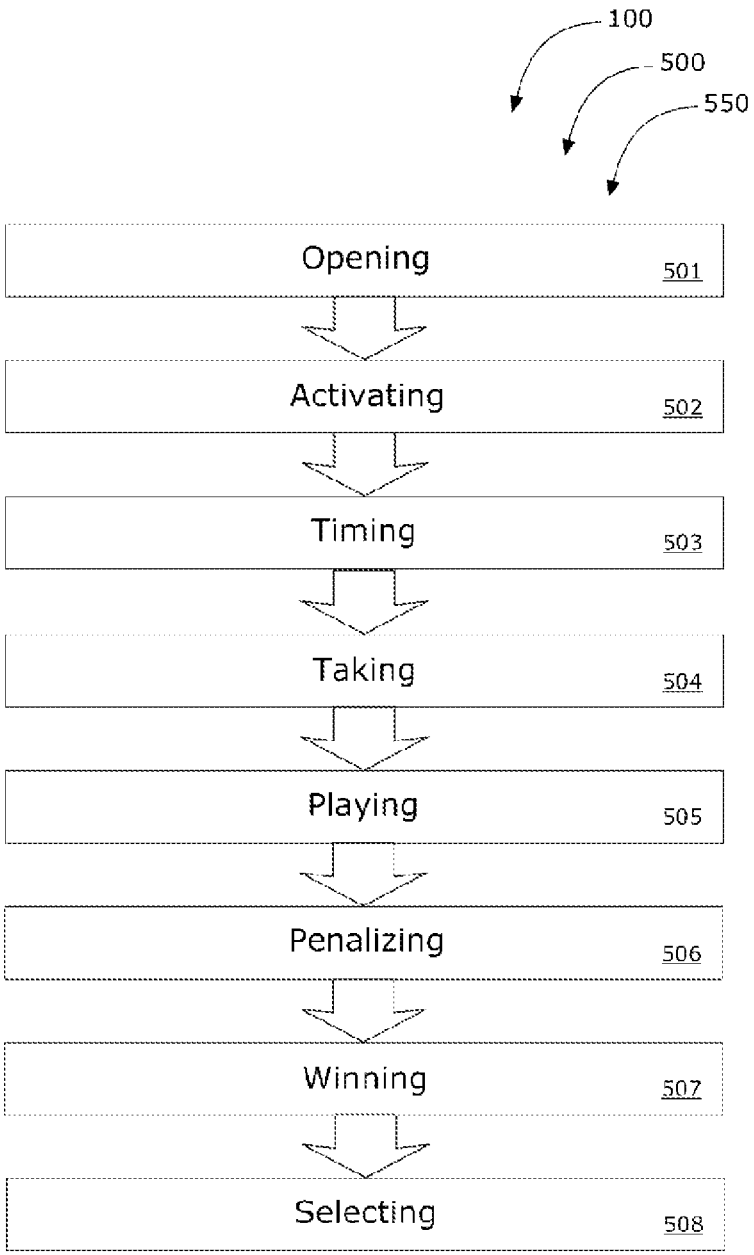
FIG. 5 is a flowchart illustrating a method of use for the speed dominoes gaming system according to an embodiment of the present invention of FIGS. 1-4.

Referring now to FIG. 5, showing a flowchart illustrating method of use 500 for speed dominoes gaming system 100 according to an embodiment of the present invention of FIGS. 1-4. Method of use 500 for speed dominoes gaming system 100 may comprise the steps of: step one 501 opening speed dominoes gaming case 105, step two 502 activating a game; step three 503 timing said move of player 140 using digital countdown clock 210; step four 504 taking turns with another player 140; step five 505 playing the game pursuant to game parameters; step six 506 penalizing player 140 if player 140 takes more than 5 seconds to make a move; step seven 507 winning game by playing all dominoes in hand, and step eight 508 selecting between level one, level two, level three, and level four.

It should be noted that step 508 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. § 112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed:

1. A speed dominoes gaming system comprising:
- a speed dominoes gaming assembly comprising;
  - a speed dominoes gaming case including:
    - two game case halves;
      - wherein said two game case halves are adapted to be pivotally connected to one another, such that in a storage configuration one game case half folds upon the other game case half for carrying said speed dominoes gaming system between locations; and
    - a handle member;
      - wherein said handle member is attached to one of said two game case halves;
  - two game platforms;
    - wherein each of said two game platforms includes a display screen thereon;
    - wherein said at least two game platforms are respectively attached to said two game case halves;
  - at least two electronic key pads;
    - wherein said at least two electronic key pads are adapted to electronically interact remotely with said at least two game platforms;
  - at least two digital countdown clocks;
  - at least two score counters;
  - at least two speakers;
  - a plurality of directional buttons;
  - at least two microprocessors;
  - at least two memory units; and
  - at least one rechargeable power supply;
- wherein said two game display screens visually display gameplay for at least two players;
- wherein said at least two electronic key pads and said plurality of directional buttons are able to be manipulated for input as to manipulate said gameplay;
- wherein said at least two digital countdown clocks is useful for timing said gameplay;
- wherein said at least two score counters provides a record of scoring throughout said gameplay;
- wherein said at least two speakers provides an audibilizing means for announcing said gameplay;
- wherein said at least two microprocessors, said at least two memory units and said at least one rechargeable power supply are in communication with each other and provide powering and controlling for said speed dominoes gaming assembly for use during said gameplay; and
- wherein said at least two electronic key pads are separate and spaced from one another, and are separate and spaced from said speed dominoes gaming case, to thereby be adapted to allow users to be adjustably spaced from one another.

2. The speed dominoes gaming system of claim 1 wherein said gameplay occurs between exactly said two players.

3. The speed dominoes gaming system of claim 1 wherein a first level comprises a timing for said gameplay limited to five seconds such that when said five seconds elapses a turn is lost.

4. The speed dominoes gaming system of claim 3 wherein a spacer-button must be pressed within said five seconds to facilitate a move.

5. The speed dominoes gaming system of claim 4 wherein said plurality of directional buttons comprises at least said spacer-button, and a pass-button.

6. The speed dominoes gaming system of claim 5 wherein said pass-button, when pushed, allows said at least two player to skip said move if desired so as not to lose a turn.

7. The speed dominoes gaming system of claim 6 wherein said move if not completed within said five seconds results in a loss in score for any seconds over said five seconds.

8. The speed dominoes gaming system of claim 7 wherein said gameplay lasts no more than 14 moves.

9. The speed dominoes gaming system of claim 8 wherein said gameplay lasts no longer than seventy seconds.

10. The speed dominoes gaming system of claim 1 wherein a second level comprises a timing for gameplay limited to four seconds such that when said four seconds elapses a turn is lost if a move isn't made.

11. The speed dominoes gaming system of claim 10 wherein when said four seconds elapses a penalty of two points incurs for every second over said four seconds.

12. The speed dominoes gaming system of claim 1 wherein a third level comprises a timing for pointplay limited to three seconds such that when said three seconds elapses a turn is lost if a move isn't made.

13. The speed dominoes gaming system of claim 12 wherein when said three seconds elapses a penalty of three points incurs for every second over said three seconds.

14. The speed dominoes gaming system of claim 1 wherein a fourth level comprises a timing for gameplay limited to two seconds such that when said two seconds elapses a turn is lost if a move isn't made.

15. The speed dominoes gaming system of claim 14 wherein when said two seconds elapses a penalty of four hundreds incurs for every second over said two seconds.

16. The speed dominoes gaming system of claim 15 wherein said gameplay is suitable for use by exactly two said at least two players.

17. The speed dominoes gaming system of claim 1 wherein each of said at least two players select two sets of seven dominos on their respective said control panel to begin a game of said speed dominos.

* * * * *